US008979230B2

(12) United States Patent
Watanabe

(10) Patent No.: US 8,979,230 B2
(45) Date of Patent: Mar. 17, 2015

(54) DRIVE DEVICE, LIQUID JET HEAD, LIQUID JET RECORDING APPARATUS, AND DRIVE METHOD

(71) Applicant: SII Printek Inc., Chiba (JP)

(72) Inventor: Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/846,543

(22) Filed: Mar. 18, 2013

(65) Prior Publication Data

US 2013/0265354 A1 Oct. 10, 2013

(30) Foreign Application Priority Data

Apr. 6, 2012 (JP) ..... 2012-087517

(51) Int. Cl.
*B41J 29/38* (2006.01)
*B41J 2/045* (2006.01)

(52) U.S. Cl.
CPC ..... *B41J 2/04588* (2013.01); *B41J 2/04541* (2013.01); *B41J 2/04581* (2013.01)
USPC ..... 347/10; 347/9; 310/316.03

(58) Field of Classification Search
USPC ..... 347/5, 9, 10, 11; 310/316.03
See application file for complete search history.

(56) References Cited

U.S. PATENT DOCUMENTS 6,841,920 B2 * 1/2005 Takamura et al. ..... 310/316.03
2009/0002036 A1 1/2009 Umeda ..... 327/108

FOREIGN PATENT DOCUMENTS

EP 1050410 11/2000
JP 2003276188 9/2003
JP 2007098795 4/2007
JP 2011031624 2/2011

OTHER PUBLICATIONS

British IPO Search Report mailed Oct. 8, 2013 issued in GB Appln. No. GB1306205.4.

* cited by examiner

*Primary Examiner* — Lam S Nguyen
(74) *Attorney, Agent, or Firm* — Adams & Wilks

(57) ABSTRACT

A device includes a drive portion for driving a pressure generating element and controlling a state of driving the element. The drive portion includes a first drive section for causing a first current to flow to drive the element, and a second drive section for causing a second current smaller than the first current to flow to drive the element. The state of driving the element includes a first state and a second state. The second drive section causes the second current to flow in a direction in which the element is switched from the first state to the second state at a timing that is faster by a predetermined time determined in advance with respect to a timing at which the first drive section causes the first current to flow for switching the state of driving the element from the first state to the second state.

14 Claims, 10 Drawing Sheets

DRIVE DEVICE, LIQUID JET HEAD, LIQUID JET RECORDING APPARATUS, AND DRIVE METHOD

BACKGROUND OF THE INVENTION

1. Field of the Invention

The present invention relates to a drive device for driving a liquid jet head which ejects liquid from nozzle holes to record images and characters on a recording medium, and to a liquid jet head, a liquid jet recording apparatus, and a drive method for the liquid jet head.

2. Description of the Related Art

Generally, a liquid jet head, to which ink (liquid) is supplied from an ink tank, includes a head chip. Ink is ejected from nozzle holes of the head chip onto a recording medium to perform recording. In some liquid droplet ejection type (ink jet type) liquid jet heads (ink jet heads) described above, there is one in which ejection of liquid droplets is performed by driving a piezoelectric actuator provided in the head chip by a head drive portion.

For example, FIG. 9 is a block diagram illustrating a configuration example of a drive portion of a liquid jet head chip which is built into the liquid jet head.

In the example illustrated in FIG. 9, a liquid jet head chip 73 includes 512 nozzles NZ1 to NZ512 (collectively referred to as "nozzle NZ"). A pressure generating element PZT corresponding to each nozzle NZ in the liquid jet head chip 73 is driven by a drive portion 100 mounted on a control circuit board 80. The drive portion 100 includes four driver ICs 101 to 104 as a drive device for the liquid jet head chip 73, and each of the driver ICs (IC1 to IC4) 101 to 104 is configured to drive the pressure generating elements PZT corresponding to the respective 128 nozzles NZ. Further, each of the driver ICs (IC1 to IC4) 101 to 104 inputs, via a connector 100A, image data for printing and various clock signals (shift CLK, pixel CLK, and the like) to be used for printing operation.

Further, FIG. 10 illustrates a configuration example of the drive device for the pressure generating element PZT, and is a block diagram illustrating, for example, a configuration example of the driver IC illustrated in FIG. 9. As illustrated in FIG. 10, the drive device (driver IC) 101 includes a selector 111, a setting value storage element 112, a waveform generating circuit 113, a shift register 121, a latch circuit (latch) 122, a waveform selecting circuit (waveform selection) 123, and a level converting circuit (level conversion) 124. Note that, details of the respective components are described in the section of embodiments below.

The drive device 101 illustrated in FIG. 10 drives, based on drive signals OUT1 to OUTn output from the level converting circuit 124, the pressure generating elements PZT corresponding to the respective n nozzles NZ in the liquid jet head chip 73 (see FIG. 9).

By the way, the drive waveform from the head drive portion, for driving the pressure generating element PZT (piezoelectric actuator), influences the liquid droplet ejection characteristics. For example, the pressure generating element PZT has a very fast response speed with respect to the drive signals OUT1 to OUTn. Therefore, when the pressure generating element PZT is driven by a square wave having a crest value Vp as shown in FIG. 11A, a rapid pressure change occurs inside the nozzle. Therefore, the meniscus motion cannot be controlled with high accuracy, and satellites or mist may be generated. Further, the side wall of the pressure generating element PZT rapidly deforms, and hence cavitation may be generated.

In view of this, as illustrated in FIG. 10 described above, a fixed resistor R is inserted between the level converting circuit 124 and a drive power supply Vd (for example, DC 30 V power supply). In this case, the pressure generating element PZT becomes a capacitive load (capacitor load), and a first order delay circuit is formed between the fixed resistor R and the electrostatic capacitance of the pressure generating element PZT.

Therefore, with the first order delay circuit formed of the fixed resistor R and the electrostatic capacitance of the pressure generating element PZT, as shown in FIG. 11B, the drive voltage for the pressure generating element PZT gently rises up to the voltage Vp while drawing a curved line. Therefore, the drive voltage waveform for the pressure generating element PZT does not rapidly increase, but gently rises from a time t1 to a time t2. Therefore, the deformation of the pressure generating element PZT also becomes gentle, and hence no rapid pressure change occurs inside the nozzle NZ. Thus, generation of cavitation and mist can be prevented.

Further, as for a drive method for the piezoelectric actuator, there is disclosed a technology of controlling the rising and falling shape of the drive waveform to control the liquid droplet ejection characteristics (for example, see Japanese Patent Application Laid-open Nos. 2007-098795 and 2003-276188).

However, Japanese Patent Application Laid-open No. 2007-098795 discloses a technology of providing, as the power supply for supplying power for driving the piezoelectric actuator, a plurality of power supply voltage sources having different output voltages, and selecting the power supply voltages output from the respective power supply voltage sources by a plurality of transistors. When the head drive portion is configured as described above, a plurality of power supply voltage sources need to be prepared, which complicates the circuit and increases the manufacturing cost.

Further, Japanese Patent Application Laid-open No. 2003-276188 discloses a technology in which a plurality of charge resistors having different resistance values are provided for limiting a current value (charge current) for driving the piezoelectric actuator and supplying power for driving the piezoelectric actuator. A plurality of transistors are provided correspondingly to those charge resistors, and a charge resistor which causes a desired current value to flow is selected by the transistors. When the head drive portion is configured as described above, not merely that the circuit configuration is complicated, but also the heat lost increases in the drive circuit forming the head drive portion, and hence the amount of heat generation increases in the head drive portion. Further, a step of trimming the charge resistors or the like is required at the time of manufacture, and hence the manufacturing cost increases.

SUMMARY OF THE INVENTION

The present invention has been made to solve the above-mentioned problems, and therefore has an object to provide a drive device for driving a liquid jet head, which is capable of controlling the shape of a drive waveform for driving the liquid jet head and reducing the amount of heat generation in a head drive portion, and to provide a liquid jet head, a liquid jet recording apparatus, and a drive method for the liquid jet head.

[1] The present invention has been made to solve the above-mentioned problems, and, according to an exemplary embodiment of the present invention, there is provided a drive device for driving a liquid jet head including: a nozzle provided with a nozzle opening; a pressure generating chamber communicated to the nozzle opening; and a pressure generating element for generating pressure fluctuations inside the pressure generating chamber in response to input of a drive waveform, the liquid jet head ejecting an ink droplet from the nozzle opening by the pressure fluctuations, the drive device including a drive portion for driving, as a load, the pressure generating element provided correspondingly to the nozzle, and controlling a state of driving the load, in which the drive portion includes: a first drive section for causing a first current to flow to drive the load; and a second drive section for causing a second current smaller than the first current to flow to drive the load, in which the state of driving the load includes a first state and a second state, and in which the second drive section causes the second current in a direction in which the load is switched from the first state to the second state to flow from a timing that is faster by a predetermined time determined in advance with respect to a timing at which the first drive section causes the first current for switching the state of driving the load from the first state to the second state to flow.

As described above, the second current in the direction in which the load is switched from the first state to the second state is caused to flow from a timing that is faster by the predetermined time determined in advance with respect to the timing at which the first drive section causes the first current for switching the state of driving the load from the first state to the second state to flow. Thus, it is possible to control the shape of the drive waveform for driving the liquid jet head. Further, the second drive portion causes the second current smaller than the first current to flow to drive the load. Thus, it is possible to reduce the loss at the drive portion and reduce the amount of heat generation in the head drive portion.

[2] Further, according to the present invention, the second drive section causes the second current for charging the load to flow from a timing that is faster by a predetermined time determined in advance with respect to a timing at which the first drive section causes the first current for charging the load to flow.

As described above, at the timing at which the load is charged, the second drive portion causes a charge current (second current) smaller than the first current to flow to drive the load. Thus, it is possible to control the shape of the drive waveform and reduce the amount of heat generation in the head drive portion.

[3] Further, according to the present invention, the second drive section causes the second current for discharging the load to flow from a timing that is faster by a predetermined time determined in advance with respect to a timing at which the first drive section causes the first current for discharging charges accumulated in the load to flow.

As described above, at the timing at which the load is discharged, the second drive portion causes a discharge current (second current) smaller than the first current to flow to drive the load. Thus, it is possible to control the shape of the drive waveform and reduce the amount of heat generation in the head drive portion.

[4] Further, according to the present invention, the second drive section limits the second current to such a current value that a change rate of a voltage of the load, which changes by causing the second current to flow, is smaller than a change rate of the voltage of the load, which changes by causing the first current to flow.

[5] Further, according to the present invention, the second drive section includes a pre-charge section which causes the second current for charging the load to flow from a timing that is faster by a predetermined time determined in advance with respect to a timing at which the first drive section causes the first current for charging the load to flow.

[6] Further, according to the present invention, the second drive section includes a pre-discharge section which causes the second current for discharging the load to flow from a timing that is faster by a predetermined time determined in advance with respect to a timing at which the first drive section causes the first current for discharging charges accumulated in the load to flow.

[7] Further, according to the present invention, the second drive section includes a current limiting section for limiting the second current for charging the load and the second current for discharging the load.

[8] Further, according to the present invention, the current limiting section has an impedance for limiting the second current, the impedance being set to a value larger than an internal resistance value of the pressure generating element.

[9] Further, according to the present invention, a timing at which the second drive section starts charging of the load is synchronized with a timing at which the first drive section switches the state of driving the load from a drive state in which charges accumulated in the load are discharged to a drive state in which a current for discharging the charges of the load is interrupted.

[10] Further, according to the present invention, a timing at which the second drive section starts discharging of charges accumulated in the load is synchronized with a timing at which the first drive section switches the state of driving the load from a drive state in which the load is charged to a drive state in which a current for charging the load is interrupted.

[11] Further, according to the present invention, the first drive section and the second drive section are supplied with power for driving the load from the same voltage power supply.

[12] Further, according to the present invention, the drive device further includes an adjustment portion for generating a first control signal for controlling the first drive section so as to drive the load and cause the first current for switching the state of driving the load from the first state to the second state to flow, and a second control signal for controlling the first drive section so as to cause the second current in the direction in which the load is switched from the first state to the second state to flow at the predetermined time before the first drive section causes the first current to flow.

[13] Further, according to another exemplary embodiment of the present invention, there is provided a liquid jet head, to be driven by the drive device according to the above-mentioned exemplary embodiment.

[14] Further, according to another exemplary embodiment of the present invention, there is provided a liquid jet recording apparatus, including the liquid jet head according to the above-mentioned another exemplary embodiment.

[15] Further, according to another exemplary embodiment of the present invention, there is provided a drive method for driving a liquid jet head including: a nozzle provided with a nozzle opening; a pressure generating chamber communicated to the nozzle opening; and a pressure generating element for generating pressure fluctuations inside the pressure generating chamber in response to input of a drive waveform, the liquid jet head ejecting an ink droplet from the nozzle opening by the pressure fluctuations, the method including driving, as a load, the pressure generating element provided correspondingly to the nozzle, and controlling a state of driving the load, in which the driving and controlling includes: causing, by a first drive section, a first current to flow to drive the load; and causing, by a second drive section, a second current smaller than the first current to flow to drive the load, in which the state of driving the load includes a first state and a second state, and in which the method further includes causing, by the second drive section, the second current in a direction in which the load is switched from the first state to the second state to flow at a predetermined time before the first drive section drives the load and causes the first current for switching the state of driving the load from the first state to the second state to flow.

According to the present invention, it is possible to control the shape of the drive waveforms for driving the liquid jet head and reduce the amount of heat generation in the head drive portion.

DETAILED DESCRIPTION OF THE PREFERRED EMBODIMENTS (First Embodiment)

(Configuration of Liquid Jet Recording Apparatus)

Figure 1:
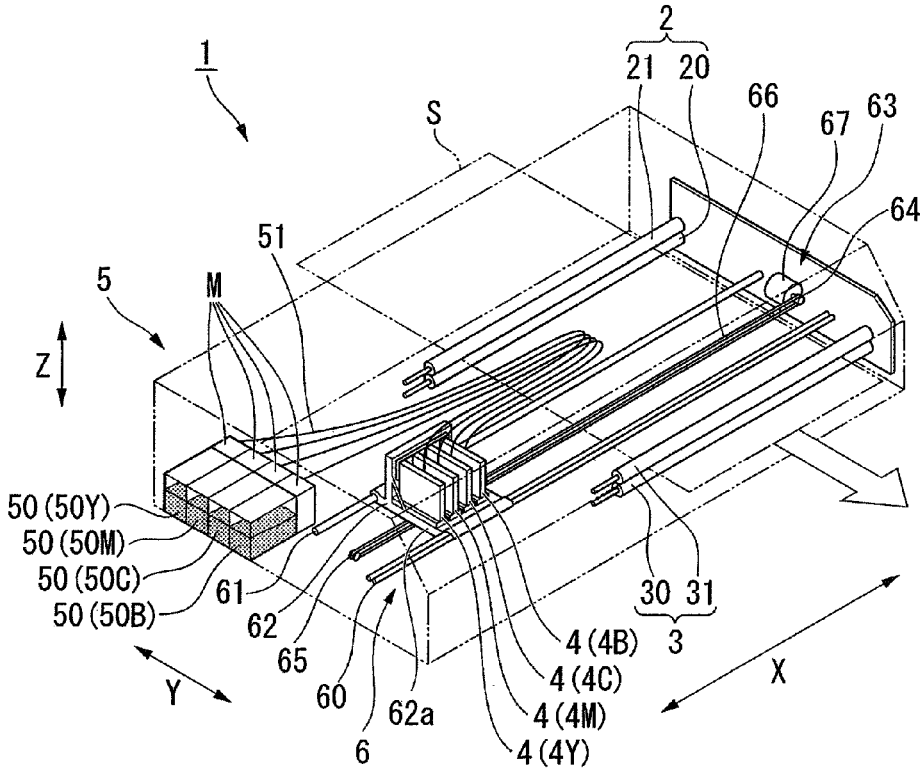
FIG. 1 is a perspective view of a liquid jet recording apparatus having a liquid jet head mounted thereon, the liquid jet head including a drive device of the present invention.

FIG. 1 illustrates an example of a liquid jet recording apparatus having a liquid jet head mounted thereon, the liquid jet head including a drive device of the present invention, and is a perspective view of a liquid jet recording apparatus 1.

The liquid jet recording apparatus 1 includes a pair of transfer means 2 and 3 for transferring a recording medium S such as paper, a liquid jet head 4 for jetting an ink droplet onto the recording medium S, liquid supply means 5 for supplying the liquid to the liquid jet head 4, and scan means 6 for causing the liquid jet head 4 to scan the recording medium S in a direction (sub scan direction) substantially orthogonal to a transfer direction (main scan direction) of the recording medium S.

In the following, description is made under the assumption that the sub scan direction is an X direction, the main scan direction is a Y direction, and a direction orthogonal to both of the X direction and the Y direction is a Z direction.

The pair of transfer means 2 and 3 include grid rollers 20 and 30 provided so as to extend in the sub scan direction, pinch rollers 21 and 31 extending in parallel with the grid rollers 20 and 30, respectively, and although not shown in detail, a drive mechanism, such as a motor, for rotating the grid rollers 20 and 30 around the axis.

The liquid supply means 5 includes a liquid container 50 for storing ink, and a liquid supply tube 51 connecting the liquid container 50 and the liquid jet head 4. A plurality of the liquid containers 50 are provided. Specifically, ink tanks 50Y, 50M, 50C, and 50B storing four types of inks of yellow, magenta, cyan, and black, respectively, are arranged. Each of the ink tanks 50Y, 50M, 50C, and 50B includes a pump motor M capable of causing ink to move under pressure toward the corresponding liquid jet head 4 through the liquid supply tube 51. The liquid supply tube 51 includes a flexible hose having flexibility, which is capable of responding to the movement of the liquid jet head 4 (carriage unit 62).

The scan means 6 includes a pair of guide rails 60 and 61 which are provided so as to extend in the sub scan direction, the carriage unit 62 which is slidable along the pair of guide rails 60 and 61, and a drive mechanism 63 for causing the carriage unit 62 to move in the sub scan direction. The drive mechanism 63 includes a pair of pulleys 64 and 65 provided between the pair of guide rails 60 and 61, an endless belt 66 wound around the pair of pulleys 64 and 65, and a drive motor 67 for rotary-driving one pulley 64.

The pulley 64 is disposed between one end portions of the pair of guide rails 60 and 61, and the pulley 65 is disposed between the other end portions of the pair of guide rails 60 and 61, and the pair of pulleys 64 and 65 are arranged with a gap provided therebetween in the sub scan direction. The endless belt 66 is disposed between the pair of guide rails 60 and 61. The carriage unit 62 is coupled to this endless belt 66. A plurality of the liquid jet heads 4 are mounted on a base end portion 62*a* of the carriage unit 62. Specifically, liquid jet heads 40Y, 40M, 40C, and 40B corresponding to the four types of inks of yellow, magenta, cyan, and black, respectively, are mounted on the carriage unit 62 while being arranged in the sub scan direction.

(Liquid Jet Head)

Figure 2:
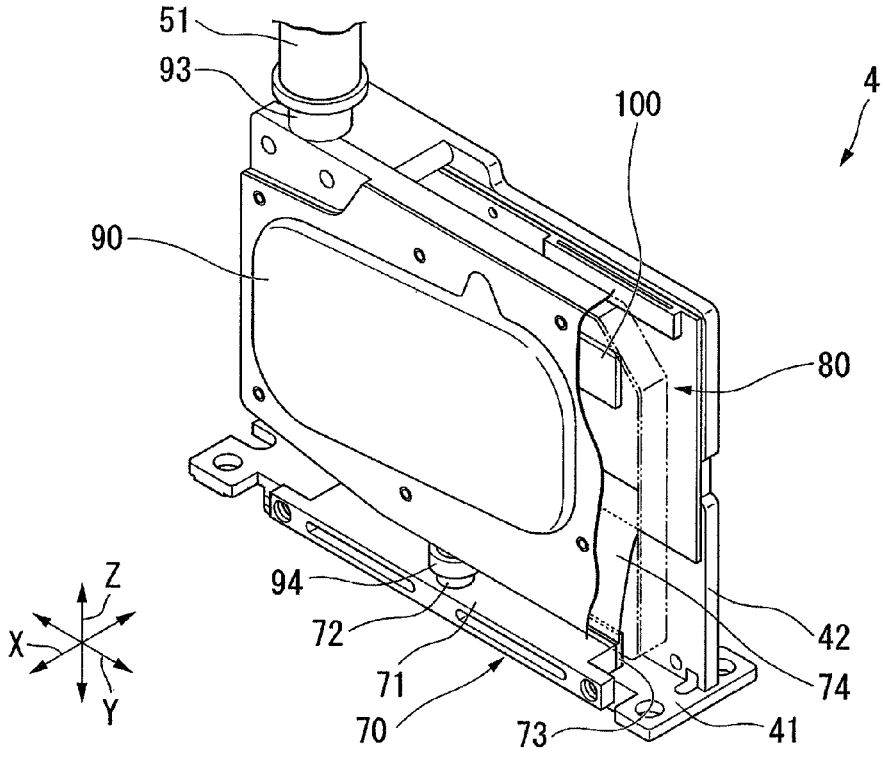
FIG. 2 is a partially cutout perspective view of the liquid jet head.

FIG. 2 is a partially cutout perspective view of the liquid jet head 4.

As illustrated in FIG. 2, the liquid jet head 4 includes, on base members 41 and 42, a jetting portion 70 for jetting ink onto the recording medium S (see FIG. 1), a control circuit board 80 electrically connected to the jetting portion 70, and a pressure damper 90 interposed between the jetting portion 70 and the liquid supply tube 51, via connection portions 93 and 94, respectively. The pressure damper 90 is provided for causing the ink to flow from the liquid supply tube 51 to the jetting portion 70 while damping the pressure fluctuations in the ink.

The jetting portion 70 includes a flow path substrate 71 which is connected to the pressure damper 90 via a connection portion 72, a liquid jet head chip 73 for jetting ink as liquid droplets onto the recording medium S through application of a voltage, and flexible wiring 74 which is electrically connected to the liquid jet head chip 73 and the control circuit board 80, for transmitting a drive signal to the liquid jet head chip 73. The control circuit board 80 includes a drive portion 100 for generating a drive pulse for the liquid jet head chip 73 based on signals such as pixel data from a main body control portion (not shown) of the liquid jet recording apparatus 1.

The liquid jet head chip 73 includes a substantially rectangular piezoelectric actuator whose longitudinal direction is in the Z direction of FIG. 2, and a plurality of nozzles formed of a plurality of nozzle openings arrayed in the Y direction of FIG. 2. The piezoelectric actuator is made of, for example, lead zirconate titanate (PZT) as a pressure generating element. Further, the piezoelectric actuator includes a pressure generating chamber communicated to each nozzle opening, and a drive electrode portion extending in a plate-like manner.

The drive electrode portion is electrically connected to the control circuit board 80 via the flexible wiring 74, and thus the drive signal is input from the control circuit board 80 to the liquid jet head chip 73. With the input of the drive signal, pressure fluctuations are generated in the pressure generating chamber, and the ink droplet is ejected from the nozzle opening by the pressure fluctuations.

Further, on a front end surface of the piezoelectric actuator (end surface on the lower side in the Z direction of FIG. 2), a nozzle plate made of polyimide and the like is provided. One main surface of the nozzle plate is a bonding surface with respect to the piezoelectric actuator, and the other main surface thereof is coated with a water-repellent film having a water-repellent property or a hydrophilic property for preventing adhesion of ink and the like.

Further, as described above, the nozzle plate has a plurality of nozzle holes (nozzle openings) formed in its longitudinal direction at predetermined intervals (intervals equivalent to the pitches of the pressure generating chambers). The nozzle hole is formed in the nozzle plate formed of a polyimide film and the like by using, for example, an excimer laser device. Those nozzle holes are arranged so as to match with the pressure generating chambers, respectively.

With such a configuration, a predetermined amount of ink is supplied from a storage chamber in the pressure damper 90 (see FIG. 2) via the connection portions 72 and 94 to the flow path substrate 71. Further, the flow path substrate 71 is communicated to the pressure generating chambers of the liquid jet head chip 73, and thus the ink can be provided across the pressure generating chambers from the connection portions 72 and 94. That is, the pressure generating chamber functions as an ink chamber into which ink is filled, whereas the flow path substrate 71 functions as a common ink chamber for communicating the respective pressure generating chambers.

(Configuration of Drive Device of First Embodiment)

Figure 3:
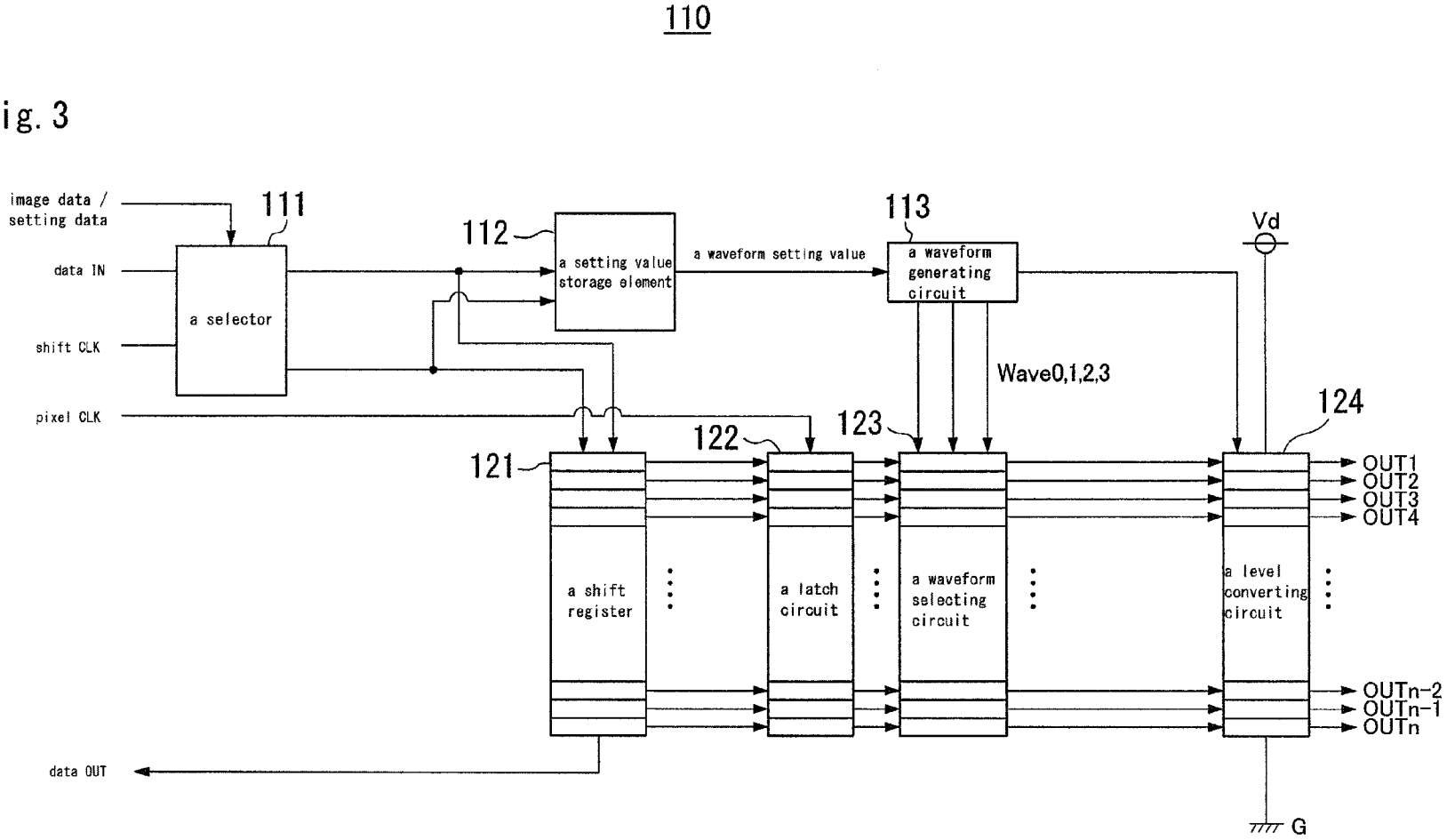
FIG. 3 is a block diagram illustrating a configuration of a drive device according to a first embodiment of the present invention.

FIG. 3 is a block diagram illustrating the configuration of the drive device according to the first embodiment of the present invention. The drive device illustrated in FIG. 3 is a device built into the liquid jet head 4 included in the liquid jet recording apparatus 1 illustrated in FIG. 1, specifically, a drive device 110 to be mounted as a driver IC on the control circuit board 80 of the liquid jet head 4 illustrated in FIG. 2. With this drive device 110, the above-mentioned piezoelectric actuator inside the liquid jet head chip 73 is driven.

Note that, in this embodiment, a part of the piezoelectric actuator corresponding to respective components of the piezoelectric actuator (drive electrode portion corresponding to each nozzle NZ and drive portion corresponding to the drive electrode portion), which are driven so as to eject an ink droplet correspondingly to each nozzle, is referred to as a pressure generating element PZT to distinguish from the integrally-formed piezoelectric actuator. Further, the phrase "drive the nozzle" more precisely means that the pressure generating element PZT corresponding to the nozzle is driven.

The drive device 110 illustrated in FIG. 3 includes a selector 111, a setting value storage element 112, a waveform generating circuit 113, a shift register 121, a latch circuit (latch) 122, a waveform selecting circuit (waveform selection) 123, and a level converting circuit (level conversion) 124.

The selector 111 inputs image data (or setting data), data IN as an image data acquisition signal, and shift CLK as a clock signal for performing data shift (data transfer) in the shift register 121. The selector 111 acquires image data in synchronization with the data IN signal, and based on the acquired image data, generates and outputs a signal D.

The signal D output from the selector 111 is output toward the shift register 121 and the setting value storage element 112. Further, the selector 111 outputs the shift CLK toward the shift register 121 and the setting value storage element 112.

The shift register 121 holds the signal D input from the selector 111 while sequentially shifting (transferring) the signal D in a period synchronized with the shift CLK. Then, after all of pieces of data to be printed (n pieces of data to be printed by the liquid jet head chip 73) are input to the shift register 121, in response to pixel CLK, the n pieces of image data (more precisely, signal D) held in the shift register 121 are latched by the latch circuit 122. Further, the shift register 121 outputs the 2-bit data held thereby to data OUT as an output signal while sequentially shifting (transferring) the data in a period synchronized with the shift CLK.

The setting value storage element 112 inputs the above-mentioned signal D and shift CLK from the selector 111.

The setting value storage element 112 holds information on a "pre-charging start time" and information on a "pre-discharging start time" for each of the nozzles. The information on the "pre-charging start time" and the information on the "pre-discharging start time" for each of the nozzles are converted by the waveform generating circuit 113 so as to be referred to as information on the waveform generation in the level converting circuit 124.

Further, the setting value storage element 112 generates a signal indicating a waveform setting value (for example, waveform height and waveform output period) which corresponds to the contents indicated by the above-mentioned signal D. This signal indicating the waveform setting value is output toward the waveform generating circuit 113.

The waveform generating circuit 113 refers to the information on the "pre-charging start time" and the information on the "pre-discharging start time" for each of the nozzles, which are held in the setting value storage element 112, converts the pieces of information to waveform shaping information for the level converting circuit 124, and outputs the waveform shaping information to the level converting circuit 124.

Further, the waveform generating circuit 113 generates a waveform signal Wave based on the signal indicating the waveform setting value input from the setting value storage element 112, and outputs the waveform signal Wave to the waveform selecting circuit 123.

Specifically, the waveform generating circuit 113 generates the waveform signal Wave including waveform signals Wave0, Wave1, Wave2, and Wave3 based on the signal indicating the waveform setting value input from the setting value storage element 112, and outputs the waveform signals to the waveform selecting circuit 123.

For example, the waveform signal Wave0 is a waveform signal to be applied to the pressure generating element PZT for preventing ink fixation. Further, the waveform signal Wave1 is a waveform signal of a pulse P1 for ejecting one ink droplet from the nozzle, the waveform signal Wave2 is a waveform signal corresponding to the pulse P1 and a pulse P2 used when two ink droplets are ejected from the nozzle, and the waveform signal Wave3 is a waveform signal corresponding to the pulse P1, the pulse P2, and a pulse P3 used when three ink droplets are ejected from the nozzle.

The waveform selecting circuit 123 selects, in accordance with the signal indicating printing data (printing data indicated by the above-mentioned signal D) for each of the nozzles, which is input from the latch circuit 122, one of the waveform signals Wave0 to Wave3 output from the waveform generating circuit 113, and outputs the selected waveform signal toward the level converting circuit 124.

The waveform selecting circuit 123 selects, based on the signal (2-bit data) input from the latch circuit 122, one of the waveform signals Wave0 to Wave3 output from the waveform generating circuit 113 correspondingly to each nozzle NZ, and outputs the selected waveform signal toward the level converting circuit 124.

The level converting circuit 124 converts, at a timing at which the image is printed, the voltage levels of the waveform signals Wave0 to Wave3 set for each of the pressure generating elements PZT, which are input from the waveform selecting circuit 123, by a power supply voltage Vd, and outputs the converted signals as drive signals OUT1 to OUTn. The pressure generating elements PZT are driven by the drive signals OUT1 to OUTn output from the level converting circuit 124, respectively.

Figure 4:
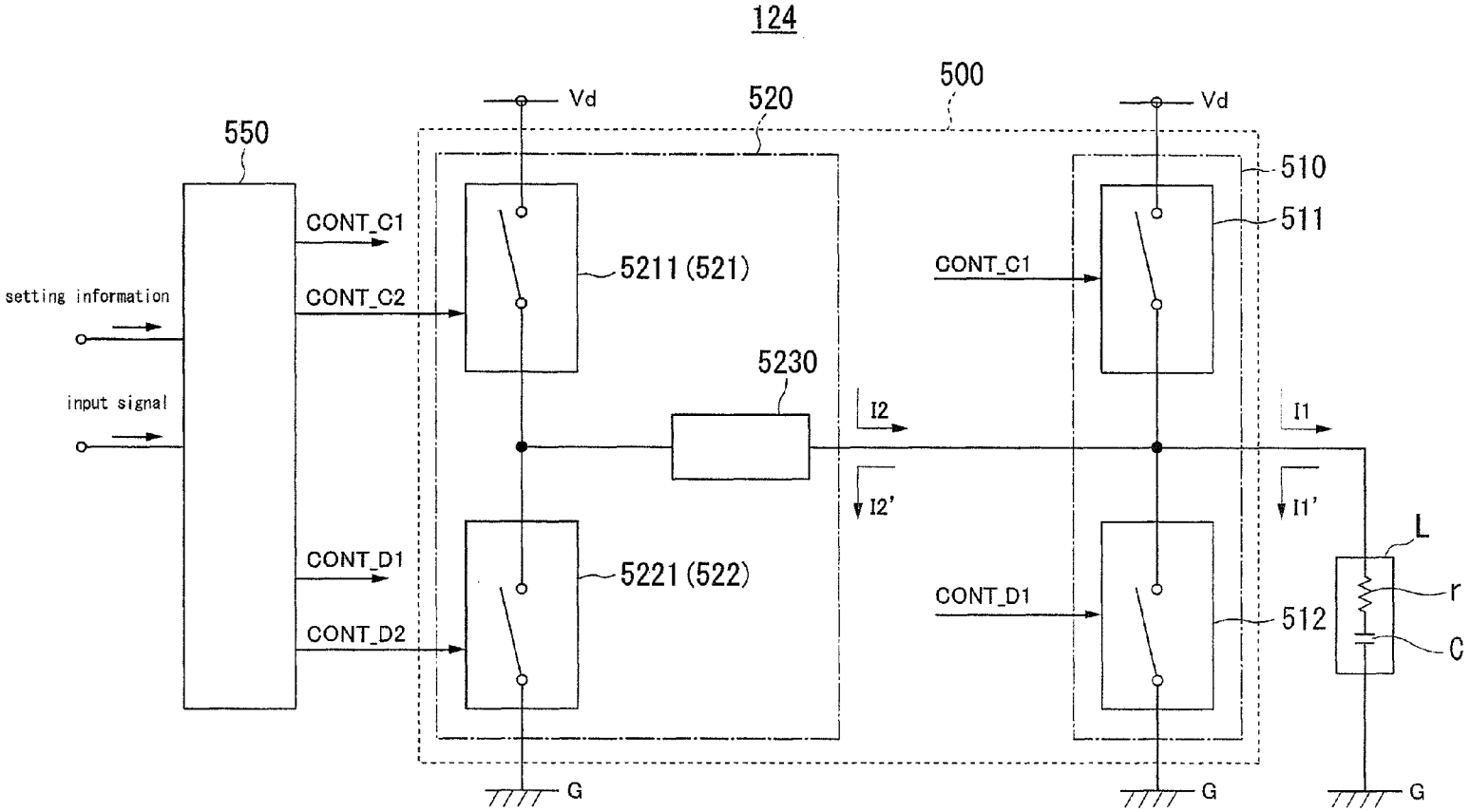
FIG. 4 is a diagram illustrating a configuration of a level converting circuit in the first embodiment of the present invention.

With reference to FIG. 4, details of the level converting circuit are described. FIG. 4 is a diagram illustrating the configuration of the level converting circuit in this embodiment.

In FIG. 4, the pressure generating element PZT provided correspondingly to each nozzle is represented by a load L. The pressure generating element PZT is modeled as a series circuit of an electrostatic capacitance C and an internal impedance r.

The level converting circuit 124 illustrated in FIG. 4 includes a drive portion 500 corresponding to each nozzle, and an adjustment portion 550. The drive portion 500 drives the pressure generating element PZT provided correspondingly to the nozzle as the load L, and controls the drive state of the load L.

The drive portion 500 includes a drive section 510 (first drive section) and a drive section 520 (second drive section). The drive section 510 causes a first current (I1 or I1') to flow to drive the load L. The drive section 520 causes a second current (I2 or I2') which is smaller than the first current (I1 or I1') to flow to drive the load L.

The adjustment portion 550 generates control signals for controlling the drive states of the drive section 510 and the drive section 520 of the drive portion 500, and supplies the control signals to the drive section 510 and the drive section 520, respectively.

Such a drive portion 500 generates a desired drive waveform for driving the load L by combining different drive sections 510 and 520 having different characteristics in current supply ability.

In the following, respective components included in the drive portion 500 are described in order. In the following description, the state of driving the load L by the drive portion 500 includes a state with voltage application and a state without voltage application. When it is not clearly specified, there are cases where one of the state with voltage application and the state without voltage application is referred to as a first state, and the other thereof is referred to as a second state.

The drive section 510 controls the first current (I1 or I1') to be caused to flow to/from the load L in accordance with the control signal from the adjustment portion 550. The drive section 510 includes a main charge section 511 and a main discharge section 512. The main charge section 511 includes a switch for interrupting a charge current (first current (I1)) to be caused to flow to the load L. The main discharge section 512 includes a switch for interrupting a discharge current (first current (I1')) to be caused to flow from the load L. The switch included in each of the main charge section 511 and the main discharge section 512 is formed of a semiconductor circuit element such as an FET and a transistor. The drive section 510 mainly supplies power for driving the load L. The drive signal waveform (voltage waveform) to be output to the load L by the drive section 510 is formed so that the voltage change rate at the rising timing and the falling timing of the waveform is large. As described above, by supplying the drive signal waveform that steeply changes to the load L by the drive section 510, the state of the pressure generating element PZT is steeply changed to eject the ink droplets.

The connection in the drive section 510 is organized. The main charge section 511 includes a power supply terminal, an output terminal, and a control signal input terminal. The power supply terminal of the main charge section 511 is connected to the power supply Vd, and the output terminal thereof is connected to the load L. The main discharge section 512 includes a ground terminal, an output terminal, and a control signal input terminal. The ground terminal of the main discharge section 512 is grounded (G), and the output terminal thereof is connected to the load L.

The drive section 520 controls the second current (I2 or I2') to be caused to flow to/from the load L in accordance with the control signal from the adjustment portion 550. The drive section 520 includes a pre-charge section 521, a pre-discharge section 522, and a current limiting section 5230. The pre-charge section 521 includes a switch for interrupting a charge current (second current (I2)) to be caused to flow to the load L. The pre-discharge section 522 includes a switch for interrupting a discharge current (second current (I2')) to be caused to flow from the load L. The switch included in each of the pre-charge section 521 and the pre-discharge section 522 is formed of a semiconductor circuit element such as an FET and a transistor. The current limiting section 5230 limits the current values of the charge current (second current (I2)) and the discharge current (second current (I2')) to be caused to flow to/from the load L. For example, the current limiting section 5230 is a resistor, and its impedance is determined in advance in accordance with the charge current (second current (I2)) and the discharge current (second current (I2')) to be caused to flow to/from the load L and the power supply voltage Vd. For example, the impedance of the current limiting section 5230 for limiting the charge current (second current (I2)) and the discharge current (second current (I2')) is set to a value larger than the internal impedance r of the pressure generating element PZT illustrated as the load L.

In contrast to the above-mentioned drive section 510, the drive section 520 supplies auxiliary power for adjusting the state of the load L. The drive signal waveform (voltage waveform) to be output to the load L by the drive section 520 is formed so that the voltage change rate at a rising timing and a falling timing of the waveform is small. Therefore, liquid droplets are not directly ejected by the power supplied from the drive section 520.

The connection in the drive section 520 is organized. The pre-charge section 521 includes a power supply terminal, an output terminal, and a control signal input terminal. The power supply terminal of the pre-charge section 521 is connected to the power supply Vd, and the output terminal thereof is connected to one end of the current limiting section 5230. The pre-discharge section 522 includes a ground terminal, an output terminal, and a control signal input terminal. The ground terminal of the pre-discharge section 522 is grounded (G), and the output terminal thereof is connected to the one end of the current limiting section 5230. The other end of the current limiting section 5230 is connected to a node that connects the main charge section 511, the main discharge section 512, and the load L.

Next, the adjustment portion 550 is described. The adjustment portion 550 generates the control signals for driving the drive section 510 and the drive section 520 configured as described above as follows.

The adjustment portion 550 generates the control signals for controlling the drive portion 500. The adjustment portion 550 is supplied with setting information in accordance with the characteristics of each nozzle. The setting information to be supplied is information based on the information on the "pre-charging start time" and the information on the "pre-discharging start time" for each nozzle. The setting information may be, as information for instructing pre-charging start and pre-discharging start for each nozzle, information for continuously instructing time or information for instructing time by some representative values. The adjustment portion 550 adjusts, in accordance with the set information, the timing for changing the following signals.

The adjustment portion 550 generates a control signal CONT_C1 (first control signal), a control signal CONT_D1 (first control signal), a control signal CONT_C2 (second control signal), and a control signal CONT_D2 (second control signal). The above-mentioned control signal CONT_C1 (first control signal), control signal CONT_D1 (first control signal), control signal CONT_C2 (second control signal), and control signal CONT_D2 (second control signal) are control signals for controlling the above-mentioned main charge section 511, main discharge section 512, pre-charge section 521, and pre-discharge section 522, respectively, and are control signals to be supplied to the control signal input terminals of the respective sections from the adjustment portion 550 to control the supply of the current to be caused to flow to the load L.

Figure 5:
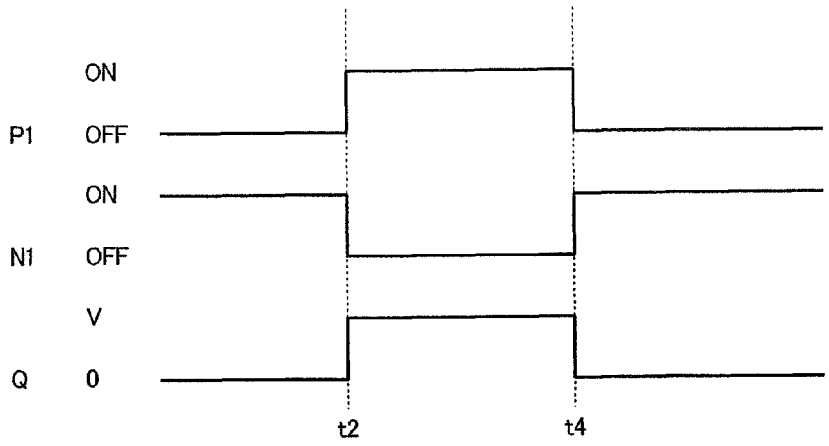
FIG. 5 is a diagram illustrating drive waveforms generated in a conventional technology.
Figure 6:
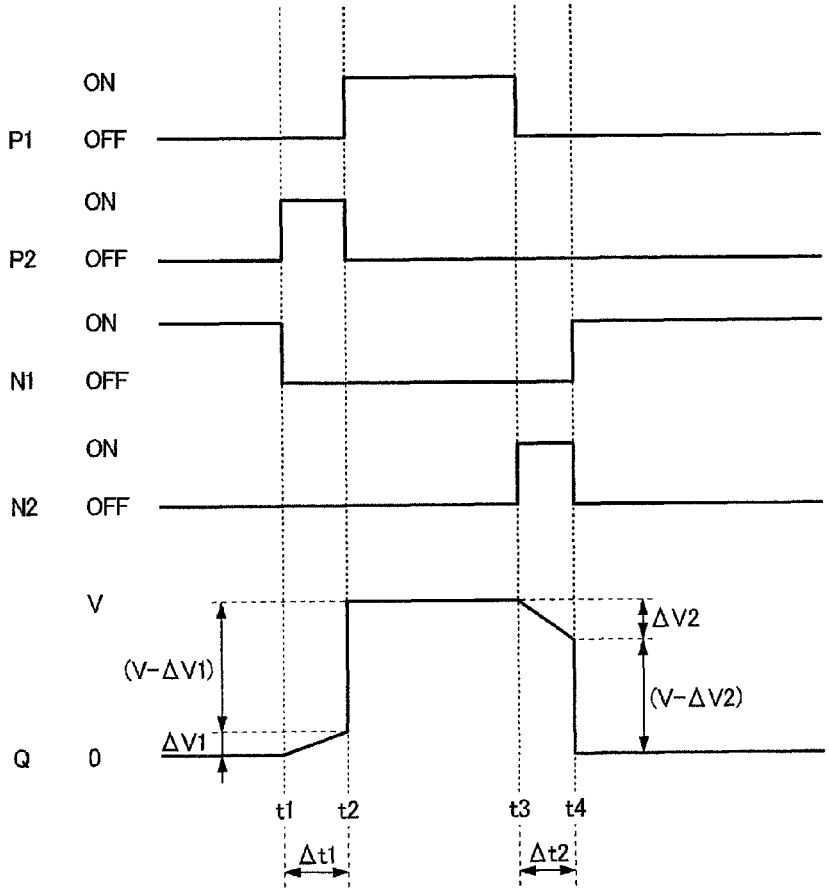
FIG. 6 is a diagram illustrating drive waveforms generated by a drive portion in the first embodiment.

With reference to FIGS. 5 and 6, the drive waveforms generated by the drive portion 500 are described.

FIG. 5 is a diagram illustrating the drive waveforms generated by the conventional technology. There is exemplified a configuration illustrated in FIG. 5, which is illustrated as an example of the conventional technology. For example, in the configuration of FIG. 4, there is presumed a drive portion not including the drive section 520 but including only the drive section 510.

In FIG. 5, a waveform P1 represents a drive waveform for charging the load, a waveform N1 represents a drive waveform for discharging the load, and a waveform Q represents a waveform indicating a voltage to be applied to the load.

In the waveform P1 and the waveform N1, the state represented by "ON" represents a state in which a current to be caused to flow to the load is caused to flow, and the state represented by "OFF" represents a state in which a current to be caused to flow to the load is interrupted. In this case, it is assumed a case where the waveform for charging the load is output in a period from a time t2 to a time t4. In a case where such a drive method as described above is performed, the waveform Q obtained as an output becomes a square waveform in which its crest value is limited by the power supply voltage (V). As described above, for example, when the charge/discharge of the load is controlled only by the drive section 510 of FIG. 4, it is only possible to obtain a square wave in which its crest value depends on the power supply voltage, and the fluctuations of the characteristics of the nozzles cannot be absorbed.

FIG. 6 is a diagram illustrating the drive waveforms generated by the drive portion of this embodiment.

The drive waveforms illustrated in FIG. 6 are waveforms obtained by the configuration of FIG. 4 illustrated as this embodiment.

In FIG. 6, a waveform P1 represents a drive waveform for charging the load L by the main charge section 511, a waveform P2 represents a drive waveform for charging the load L by the pre-charge section 521, a waveform N1 represents a drive waveform for discharging the load L by the main discharge section 512, a waveform N2 represents a drive waveform for discharging the load L by the pre-discharge section 522, and a waveform Q represents a waveform indicating a voltage to be applied to the load L.

In the waveform P1, the waveform P2, the waveform N1, and the waveform N2, the state represented by "ON" represents a state in which a current to be caused to flow to the load L is caused to flow by each section, and the state represented by "OFF" represents a state in which a current to be caused to flow to the load L is interrupted by each section. In this case, it is assumed a case where the waveform which maintains a state in which the load L is charged is output in a period from a time t1 to the time t4. Note that, a period until the time t1 and a period after the time t4 are in states in which the voltage is not applied to the load L.

The state before the time t1 is an initial state in which the discharge by the previously-generated drive waveform is completed, and as illustrated in order by the waveform P1, the waveform P2, the waveform N1, and the waveform N2, the main charge section 511, the pre-charge section 521, and the pre-discharge section 522 are in the "OFF" state in which the current is interrupted, and main discharge section 512 is in the "ON" state in which the current is caused to flow for discharge.

At the time t1, the states of the pre-charge section 521 and the main discharge section 512 are inverted, and thus only the pre-charge section 521 (waveform P2) is set in the "ON" state, and the other sections are set in the "OFF" state. In short, the load L is set to a "pre-charging" state. As illustrated in the waveform Q, by maintaining this state, the load L (electrostatic capacitance C) is gradually charged in accordance with the elapse of time, and the voltage of the load L is charged up to a voltage ?V1 when a time ?t1 has elapsed (time t2).

At the time t2, the states of the main charge section 511 and the pre-charge section 521 are inverted, and thus the main charge section 511 (waveform P1) is set to the "ON" state, and the other sections are set to the "OFF" state. In short, the load L is set to a "main charging" state.

The voltage of the load L has been already charged up to the voltage ΔV1 by the "pre-charging" until reaching the time t2. When the charging by the main charge section 511 (waveform P1) is started, the voltage of the load L is charged instantaneously from the voltage ΔV1 to the voltage V. By transiting the state as described above, a change of (V−ΔV1) is generated in the voltage of the load L.

At the time t3, the states of the main charge section 511 and the pre-discharge section 522 are inverted, and thus only the pre-discharge section 522 (waveform N2) is set to the "ON" state, and the other sections are set to the "OFF" state. In short, the load L is set to a "pre-discharging" state. As illustrated in the waveform Q, by maintaining this state, the load L (electrostatic capacitance C) is gradually discharged in accordance with the elapse of time, and after the elapse of a time Δt2, the voltage reduces by a voltage ΔV2. Thus, the load is in a state in which a voltage (V−ΔV2) is charged (time t4).

At the time t4, the states of the main discharge section 512 and the pre-discharge section 522 are inverted, and thus the main discharge section 512 (waveform N1) is set to the "ON"

state, and the other sections are set to the "OFF" state. In short, the load L is set to a "main discharging" state.

The voltage of the load L has already been in a state in which the voltage (V−ΔV2) is charged by the "pre-charging" until reaching the time t4. When the discharging by the main discharge section 512 (waveform N1) is started, through instantaneous discharging, the voltage of the load L changes from the voltage Δ(V−ΔV2) to a reference potential. By transiting the state as described above, a voltage change of (V−ΔV/2) is generated in the voltage of the load L.

The adjustment portion 550 controls the drive portion 500 as described above, and thus the drive waveform illustrated as the waveform Q can be output from the drive portion 500.

The voltage change generated at the time t2 appears as a voltage change of a potential difference of (V−ΔV1). The voltage change generated at the time t4 appears as a voltage change of a potential difference of (V−ΔV2). As described above, by adjusting the voltages ΔV1 and ΔV2, the voltage width to be instantaneously-changed in the voltage to be applied to the pressure generating element PZT can be adjusted. The characteristics of the pressure generating element PZT for ejecting liquid droplets depend on the voltage width to be instantaneously-changed in the voltage to be applied to the pressure generating element PZT. Therefore, in accordance with the liquid droplet ejection characteristics of each nozzle, the voltages ΔV1 and ΔV2 are adjusted. In this manner, the fluctuations in liquid droplet ejection characteristics of the nozzles can be absorbed.

As described above, the pre-charge section 521 starts charging of the load L from the time t1 that is faster by Δt1 (predetermined time) determined in advance with respect to the time t2, and the pre-discharge section 522 starts discharging of the charges accumulated in the load L from the time t3 that is faster by Δt2 (predetermined time) determined in advance with respect to the time t4. In this manner, the fluctuations in liquid droplet ejection characteristics of the nozzles are absorbed.

Note that, at the time t2, the states of the main charge section 511 and the pre-charge section 521 are inverted, but there is a case where, when the timing to set the main charge section 511 (waveform P1) to the "ON" state is delayed from the timing to set the pre-charge section 521 to the "OFF" state, unnecessary pressure fluctuations are generated in the pressure generation chamber. In this embodiment, adjustment is made so that, after the main charge section 511 (waveform P1) is set to the "ON" state, the pre-charge section 521 is set to the "OFF" state, to thereby prevent the unnecessary pressure fluctuations from being generated in the pressure generation chamber.

Note that, the adjustment of the timings at the time t2 can be made as follows. After the elapse of a predetermined time after the main charge section 511 (waveform P1) is set to the "ON" state, the pre-charge section 521 is set to the "OFF" state.

Note that, at the time t4, the states of the main discharge section 512 and the pre-discharge section 522 are inverted, but there is a case where, when the timing to set the main discharge section 512 (waveform N1) to the "ON" state is delayed from the timing to set the pre-discharge section 522 to the "OFF" state, unnecessary pressure fluctuations are generated in the pressure generation chamber. In this embodiment, adjustment is made so that, after the main discharge section 512 (waveform N1) is set to the "ON" state, the pre-discharge section 522 is set to the "OFF" state, to thereby prevent the unnecessary pressure fluctuations from being generated in the pressure generation chamber.

Note that, the adjustment of the timings at the time t4 can be made as follows. After the elapse of a predetermined time after the main discharge section 512 (waveform N1) is set to the "ON" state, the pre-discharge section 522 is set to the "OFF" state.

As described above, by adjusting the timings at the times t2 and t4, it is possible to prevent the unnecessary pressure fluctuations from being generated in the pressure generation chamber. Note that, the management of the timing to change each signal cannot be performed only by the four timings of the times t1, t2, t3, and t4, and, in order to manage the timings delayed from the times t2 and t4, management of six timings is necessary for each nozzle.

(Second Embodiment)

Figure 7:
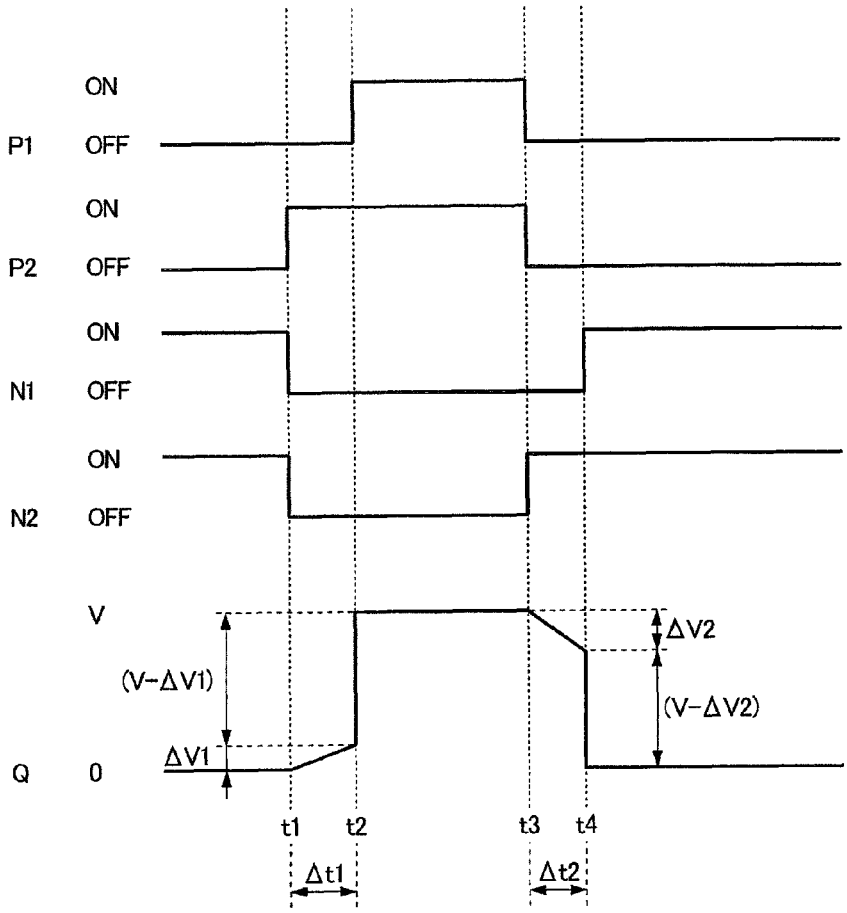
FIG. 7 is a diagram illustrating drive waveforms generated by a drive portion according to a second embodiment of the present invention.

With reference to FIG. 7, the drive waveforms generated by the drive portion are described. FIG. 7 is a diagram illustrating drive waveforms generated by the drive portion of this embodiment. The drive waveforms illustrated in FIG. 7 are waveforms obtained by the configuration of FIG. 4 illustrated as this embodiment.

The drive method illustrated in FIG. 7 is a drive method that performs transition of the states of the pre-charge section 521 (waveform P2) and the pre-discharge section 522 (waveform N2) at different timings from those in the above-mentioned drive method illustrated in FIG. 6.

In the above-mentioned drive method illustrated in FIG. 6, the adjustment of the timings at the times t2 and t4 needs to be cared, but, in the drive method described in this embodiment, such an adjustment is unnecessary.

In FIG. 7, similarly to FIG. 6 described above, a waveform P1 represents a drive waveform for charging the load L by the main charge section 511, a waveform P2 represents a drive waveform for charging the load L by the pre-charge section 521, a waveform N1 represents a drive waveform for discharging the load L by the main discharge section 512, a waveform N2 represents a drive waveform for discharging the load L by the pre-discharge section 522, and a waveform Q represents a waveform indicating a voltage to be applied to the load L.

In the waveform P1, the waveform P2, the waveform N1, and the waveform N2, the state represented by "ON" represents a state in which a current to be caused to flow to the load L is caused to flow by each section, and the state represented by "OFF" represents a state in which a current to be caused to flow to the load L is interrupted by each section. In this case, it is assumed a case where the waveform which maintains a state in which the load L is charged is output in the period from the time t1 to the time t4.

The state before the time t1 is an initial state in which the discharge by the previously-generated drive waveform is completed, and as illustrated in order by the waveform P1, the waveform P2, the waveform N1, and the waveform N2, the main charge section 511 and the pre-charge section 521 are in the "OFF" state in which the current is interrupted, and the main discharge section 512 and the pre-discharge section 522 are in the "ON" state in which the current is caused to flow for discharge.

At the time t1, the states of the pre-charge section 521, the main discharge section 512, and the pre-discharge section 522 are inverted, and thus only the pre-charge section 521 (waveform P2) is set in the "ON" state, and the other sections are set in the "OFF" state. In short, the load L is set to a "pre-charging" state. As illustrated in the waveform Q, by maintain this state, the load L (electrostatic capacitance C) is gradually charged in accordance with the elapse of time, and the voltage of the load L is charged up to the voltage ΔV1 when the time Δt1 has elapsed (time t2).

At the time t2, the state of the main charge section 511 is inverted, and thus the main charge section 511 (waveform P1) and the pre-charge section 521 (waveform P2) are set to the "ON" state, and the other sections are set to the "OFF" state. In short, the load L is set to a "main charging" state.

The voltage of the load L has been already charged up to the voltage ΔV1 by the "pre-charging" until reaching the time t2. When the charging by the main charge section 511 (waveform P1) is started, the voltage of the load L is charged instantaneously from the voltage ΔV1 to the voltage V. By transiting the state as described above, a change of (V−ΔV1) is generated in the voltage of the load L.

At the time t3, the states of the main charge section 511, the pre-charge section 521, and the pre-discharge section 522 are inverted, and thus only the pre-discharge section 522 (waveform N2) is set to the "ON" state, and the other sections are set to the "OFF" state. In short, the load L is set to a "pre-discharging" state. As illustrated in the waveform Q, by maintaining this state, the load L (electrostatic capacitance C) is gradually discharged in accordance with the elapse of time, and after the elapse of the time Δt2, the voltage reduces by the voltage ΔV2. Thus, the load is in a state in which the voltage (V−ΔV2) is charged (time t4).

At the time t4, the state of the main discharge section 512 is inverted, and thus the main discharge section 512 (waveform N1) and the pre-discharge section 522 (waveform N2) are set to the "ON" state, and the other sections are set to the "OFF" state. In short, the load L is set to a "main charging" state.

The voltage of the load L has already been in a state in which the voltage (V−ΔV2) is charged by the "pre-charging" until reaching the time t4. When the discharging by the main discharge section 512 (waveform N1) is started, through instantaneous discharging, the voltage of the load L changes from the voltage Δ(V−ΔV2) to a reference potential. By transiting the state as described above, a voltage change of (V−ΔV2) is generated in the voltage of the load L.

The adjustment portion 550 controls the drive portion 500 as described above, and thus the drive waveform illustrated as the waveform Q can be output from the drive portion 500.

The voltage change generated at the time t2 appears as a voltage change of a potential difference of (V−ΔV1). The voltage change generated at the time t4 appears as a voltage change of a potential difference of (V−ΔV2). As described above, by adjusting the voltages ΔV1 and ΔV2, the voltage width to be instantaneously-changed in the voltage to be applied to the pressure generating element PZT can be adjusted. The characteristics of the pressure generating element PZT for ejecting liquid droplets depend on the voltage width to be instantaneously-changed in the voltage to be applied to the pressure generating element PZT. Therefore, in accordance with the liquid droplet ejection characteristics of each nozzle, the voltages ΔV1 and ΔV2 are adjusted. In this manner, the fluctuations in liquid droplet ejection characteristics of the nozzles can be absorbed.

(Third Embodiment)

Figure 8:
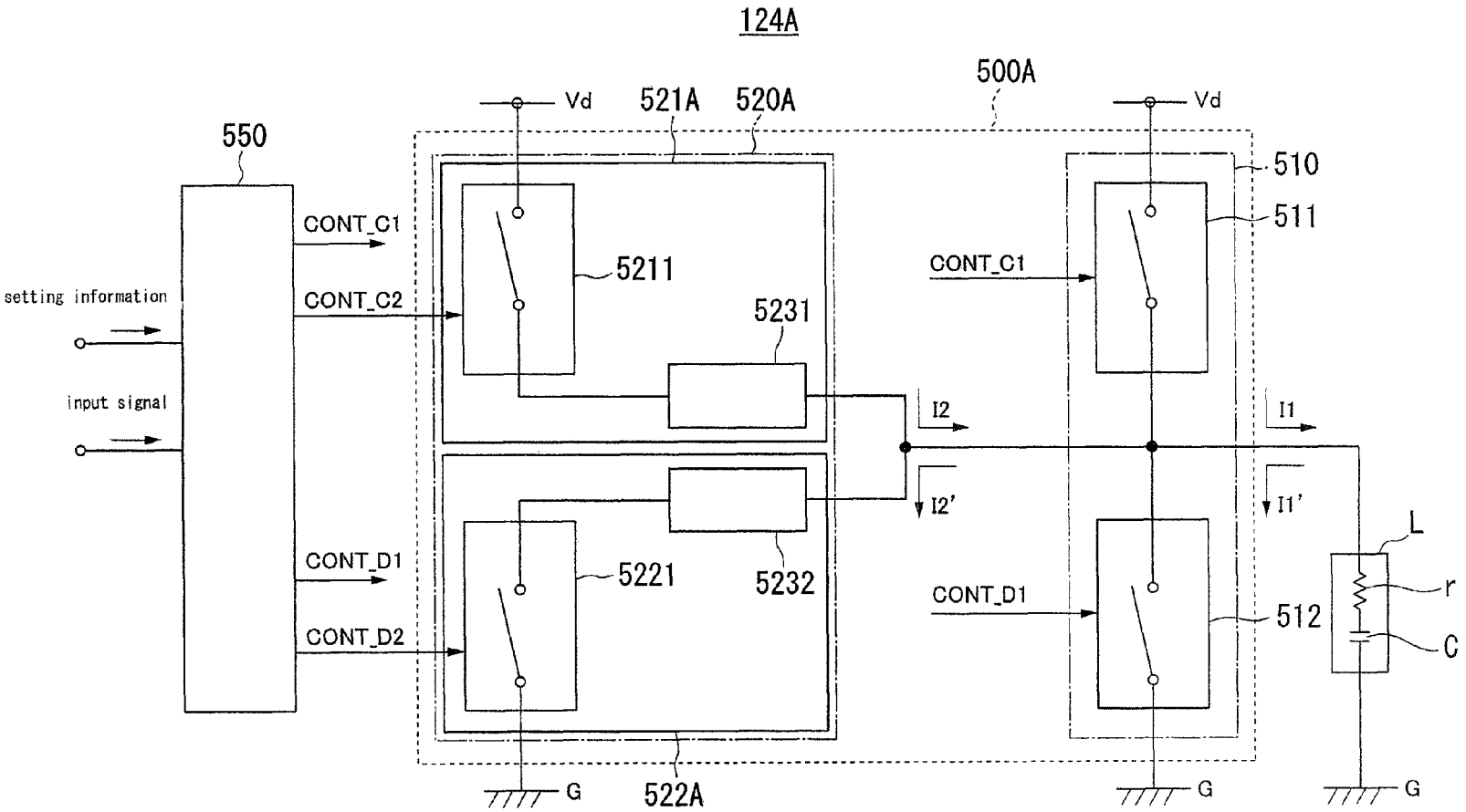
FIG. 8 is a block diagram illustrating a configuration of a drive device according to a third embodiment of the present invention.
Figure 9:
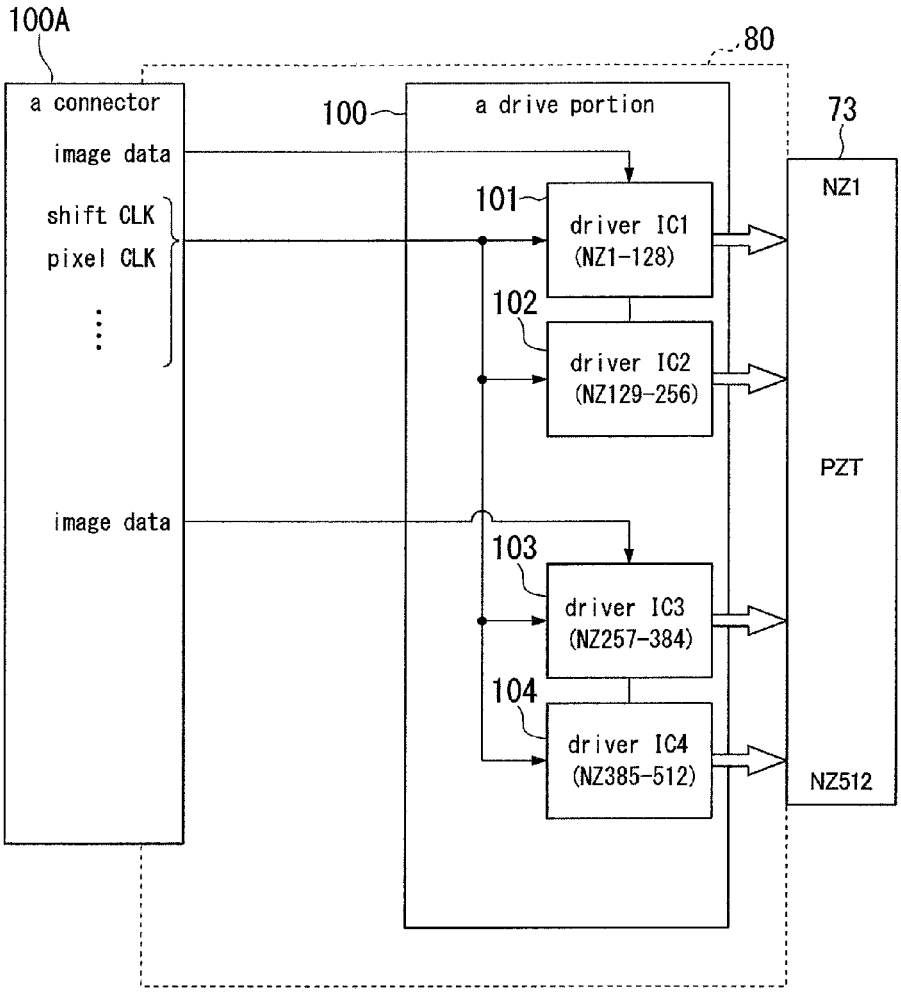
FIG. 9 is a block diagram illustrating a configuration example of the drive portion of a liquid jet head chip.
Figure 10:
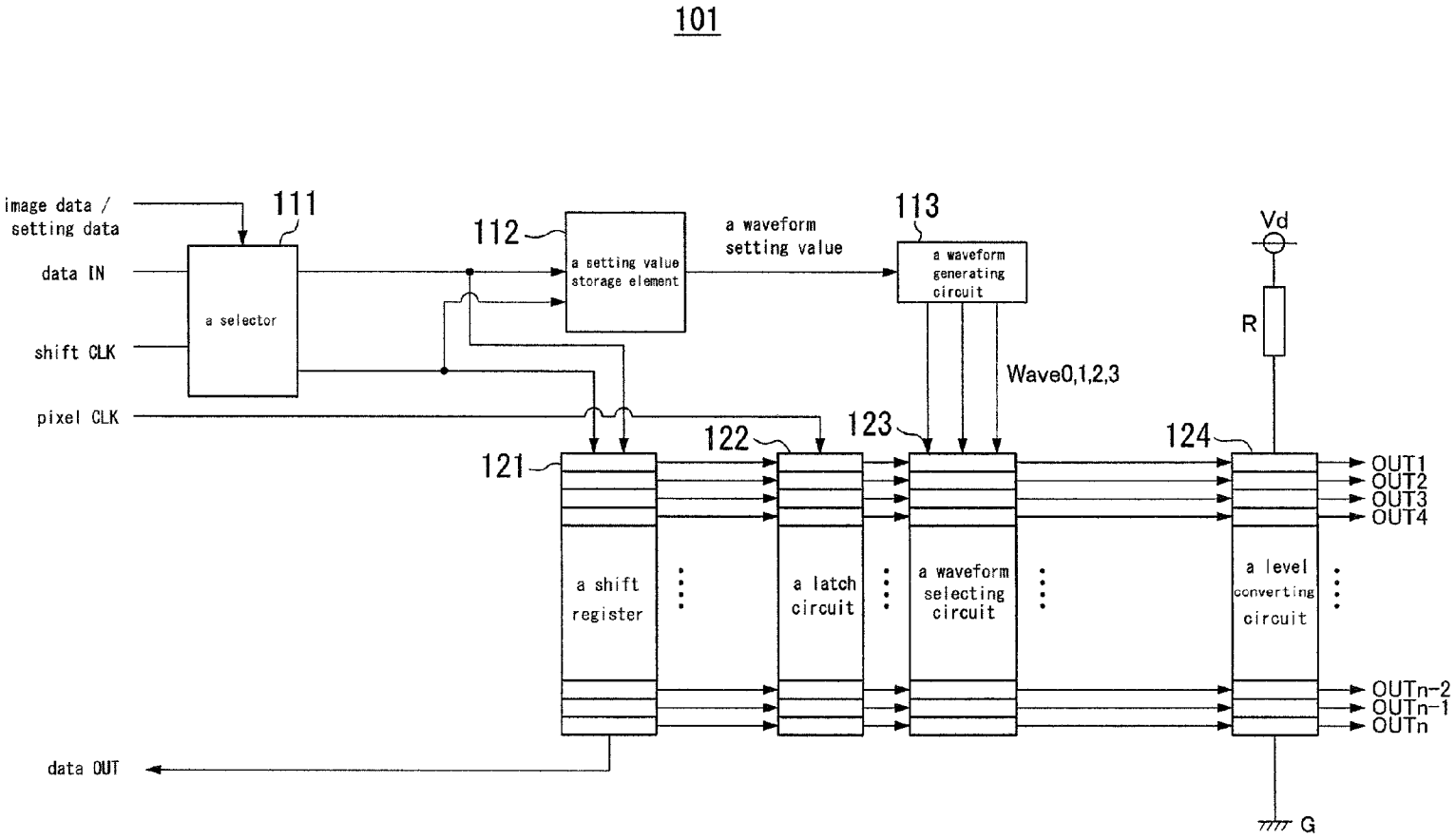
FIG. 10 is a diagram illustrating a configuration example of the drive device for a pressure generating element PZT.
Figure 11A:
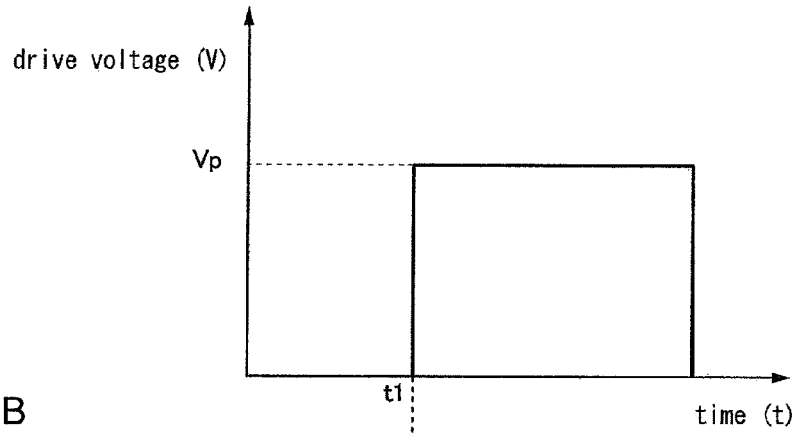
FIGS. 11A and 11B are graphs showing examples of drive waveforms for the pressure generating element PZT.
Figure 11B:
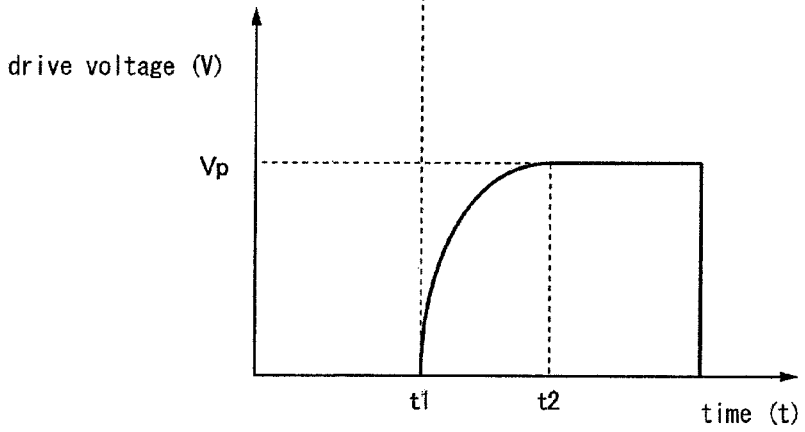

With reference to FIG. 8, details of the level converting circuit are described. FIG. 8 is a diagram illustrating a configuration of the level converting circuit in this embodiment.

A level converting circuit 124A illustrated in FIG. 8 differs from the above-mentioned level converting circuit 124 illustrated in FIG. 4 in that the drive section 520 (second drive section) is replaced by a drive section 520A (second drive section).

The drive section 520A controls the second current (I2 or I2') to be caused to flow to/from the load L in accordance with the control signal from the adjustment portion 550. The drive section 520A includes a pre-charge section 521A and a pre-discharge section 522A. The pre-charge section 521A includes a switch 5211 for interrupting the charge current (second current (I2)) to be caused to flow to the load L, and a current limiting section 5231. The pre-discharge section 522A includes a switch 5221 for interrupting the discharge current (second current (I2')) to be caused to flow from the load L, and a current limiting section 5232.

The connection in the drive section 520A is organized. The pre-charge section 521A includes a power supply terminal, an output terminal, and a control signal input terminal. The power supply terminal of the pre-charge section 521A is connected to the power supply Vd, and the output terminal thereof is connected to the main charge section 511, the main discharge section 512, and the load L.

The pre-discharge section 522A includes a ground terminal, an output terminal, and a control signal input terminal. The ground terminal of the pre-discharge section 522A is grounded (G), and the output terminal thereof is connected to a node connecting the main charge section 511, the main discharge section 512, and the load L.

The configuration of the drive section 520A is different from the above-mentioned drive section 520 in detail, but the drive section 520A can function similarly to the drive section 520.

As described above, the current limiting section can be separated for charging and discharging. By separating the current limiting section for charging and discharging, it becomes easy to set the currents during charging and discharging independently.

The embodiments of the present invention have been described above, but the drive device 110 of the present invention is not limited to the illustrated example described above, and it is needless to say that various modifications can be made thereto without departing from the gist of the present invention.

For example, the drive methods described in the first and second embodiments can be combined to each other so that the drive method for the drive waveform rise employs the drive method of the first embodiment, and the drive method for the drive waveform fall employs the drive method of the second embodiment.

Further, for example, in the pre-charge section 521A described in the third embodiment, the switch 5211 for interrupting the charge current (second current (I2)) to be caused to flow to the load L is connected in series to the current limiting section 5231. The connection order of the switch 5211 and the current limiting section 5231 can be inverted from that illustrated in FIG. 8.

Further, in the pre-discharge section 522A, the switch 5221 for interrupting the discharge current (second current (I2')) to be caused to flow from the load L is connected in series to the current limiting section 5232. The connection order of the switch 5221 and the current limiting section 5232 can be inverted from that illustrated in FIG. 8.

Note that, any one of the current limiting section 5231 and the current limiting section 5232 may be configured as a constant current circuit.

What is claimed is:

1. A drive device for driving a liquid jet head, comprising:

a nozzle provided with a nozzle opening;

a pressure generating chamber communicating with the nozzle opening;

a pressure generating element for generating pressure fluctuations inside the pressure generating chamber in response to input of a drive waveform to eject an ink droplet from the nozzle opening; and a drive portion for driving, as a load, the pressure generating element and controlling a state of driving the load, the drive portion comprising:

a first drive section for causing a first current to flow to drive the load; and a second drive section for causing a second current smaller than the first current to flow to drive the load, wherein the state of driving the load comprises a first state and a second state, wherein the second drive section causes the second current to flow in a direction in which the load is switched from the first state to the second state from a timing that is faster by a predetermined time determined in advance with respect to a timing at which the first drive section causes the first current to flow for switching the state of driving the load from the first state to the second state, and wherein the second drive section limits the second current to such a current value that a change rate of a voltage of the load, which changes by causing the second current to flow, is smaller than a change rate of the voltage of the load, which changes by causing the first current to flow.

2. A drive device according to claim 1, wherein the second drive section causes the second current for charging the load to flow from a timing that is faster by a predetermined time determined in advance with respect to a timing at which the first drive section causes the first current for charging the load to flow.

3. A drive device according to claim 1, wherein the second drive section causes the second current for discharging the load to flow from a timing that is faster by a predetermined time determined in advance with respect to a timing at which the first drive section causes the first current for discharging charges accumulated in the load to flow.

4. A drive device according to claim 1, wherein the second drive section comprises a pre-discharge section which causes the second current for charging the load to flow from a timing that is faster by a predetermined time determined in advance with respect to a timing at which the first drive section causes the first current for charging the load to flow.

5. A drive device according to claim 1, wherein the second drive section comprises a pre-discharge section which causes the second current for discharging the load to flow from a timing that is faster by a predetermined time determined in advance with respect to a timing at which the first drive section causes the first current for discharging charges accumulated in the load to flow.

6. A drive device according to claim 1, wherein the second drive section comprises a current limiting section for limiting the second current for charging the load and the second current for discharging the load.

7. A drive device according to claim 6, wherein the current limiting section has an impedance for limiting the second current, the impedance being set to a value larger than an internal impedance of the pressure generating element.

8. A drive device according to claim 1, wherein a timing at which the second drive section starts charging of the load is synchronized with a timing at which the first drive section switches the state of driving the load from a drive state in which charges accumulated in the load are discharged to a drive state in which a current for discharging the charges of the load is interrupted.

9. A drive device according to claim 1, wherein a timing at which the second drive section starts discharging of charges accumulated in the load is synchronized with a timing at which the first drive section switches the state of driving the load from a drive state in which the load is charged to a drive state in which a current for charging the load is interrupted.

10. A drive device according to claim 1, wherein the first drive section and the second drive section are supplied with power for driving the load from the same voltage power supply.

11. A drive device according to claim 1, further comprising an adjustment portion for generating a first control signal for controlling the first drive section so as to drive the load and cause the first current for switching the state of driving the load from the first state to the second state to flow, and a second control signal for controlling the second drive section so as to cause the second current in the direction in which the load is switched from the first state to the second state to flow at the predetermined time before the first drive section causes the first current to flow.

12. A liquid jet head, to be driven by the drive device according to claim 1.

13. A liquid jet recording apparatus, comprising the liquid jet head according to claim 12.

14. A drive method for driving a liquid jet head that includes a nozzle provided with a nozzle opening, a pressure generating chamber communicating with the nozzle opening, and a pressure generating element for generating pressure fluctuations inside the pressure generating chamber in response to input of a drive waveform to eject an ink droplet from the nozzle opening, the method comprising:

driving, as a load, the pressure generating element and controlling a state of driving the load in a first state and a second state, wherein the driving and controlling comprises:

causing, by a first drive section, a first current to flow to drive the load;

causing, by a second drive section, a second current smaller than the first current to flow to drive the load, causing, by the second drive section, the second current to flow in a direction in which the load is switched from the first state to the second state at a predetermined time before the first drive section drives the load and causes the first current to flow for switching the state of driving the load from the first state to the second state, and causing, by the second drive section, the second current to be limited to such a current value that a change rate of a voltage of the load, which changes by causing the second current to flow, is smaller than a change rate of the voltage of the load, which changes by causing the first current to flow.

* * * * *